US006730879B1

(12) United States Patent
Muegge et al.

(10) Patent No.: US 6,730,879 B1
(45) Date of Patent: May 4, 2004

(54) SELF-CLEANING SYSTEMS AND METHODS

(75) Inventors: Coleen Judith Muegge, Louisville, KY (US); Jennifer Elizabeth Rael, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/249,048

(22) Filed: Mar. 12, 2003

(51) Int. Cl.[7] ..... A21B 1/02; A21B 1/40

(52) U.S. Cl. ..... 219/393; 219/398; 219/413; 219/486

(58) Field of Search ..... 219/393, 395, 219/397, 398, 413, 484, 486, 491

(56) References Cited

U.S. PATENT DOCUMENTS 3,656,182 A * 4/1972 Staples ..... 337/319
3,875,372 A * 4/1975 Gilliom ..... 219/413
4,302,661 A 11/1981 Perry, Jr.
4,775,777 A * 10/1988 Sinn ..... 219/413
4,831,237 A * 5/1989 Gelineau ..... 219/398
5,534,678 A 7/1996 Bowles et al.
5,571,433 A 11/1996 Baker
6,232,584 B1 * 5/2001 Meyer ..... 219/393
6,316,749 B1 11/2001 Bales et al.
2002/0005401 A1 * 1/2002 Meyer et al. ..... 219/413

* cited by examiner

*Primary Examiner*—Joseph Pelham
(74) *Attorney, Agent, or Firm*—H. Neil Houser, Esq.; Armstrong Teasdale LLP

(57) ABSTRACT

A self-cleaning oven includes a cooking chamber, a first heating element inside the cooking chamber, and a second heating element inside the cooking chamber. The first and second heating elements are configured to be energized simultaneously during a first stage of a self-cleaning operation of the oven.

17 Claims, 3 Drawing Sheets

SELF-CLEANING SYSTEMS AND METHODS

BACKGROUND OF INVENTION

This invention relates generally to self-cleaning systems and methods, and more particularly, to self-cleaning systems and methods for self-cleaning ovens.

A self-cleaning oven typically has multiple heating elements that are used for multiple operations, such as, for instance, baking, broiling, and self-cleaning. Substances baked or broiled inside the oven generate soils, such as, for example, grease. The soils are deposited on walls of a chamber of the oven.

The oven engages in a self-cleaning operation to remove soils from the walls. The self-cleaning operation usually has two stages. During a first stage, there is an increase in temperature in the chamber of the oven. During a second stage, there is a periodic increase and decrease in temperature in the chamber.

Generally, during the first stage of the self-cleaning operation, only one of the heating elements is energized at a given time. For instance, the broil heating element is energized during the first stage. One reason for energizing only one of the heating elements at a given time is that the oven has an ampere circuit rating that allows for energization of only one of the heating elements at a given time.

The self-cleaning operation takes a long time, for instance, from 3 to 6 hours, to remove the soils. The long time is a consequence of being able to energize only one of the heating elements at a time during the first stage.

SUMMARY OF INVENTION

In one aspect, a self-cleaning oven includes a cooking chamber, a first heating element inside the cooking chamber, and a second heating element inside the cooking chamber. The first and second heating elements are configured to be energized simultaneously during a first stage of a self-cleaning operation of the oven.

In another aspect, a method for performing a self-cleaning operation in an oven includes energizing a first heating element of the oven during a first stage of a self-cleaning operation. The method also includes simultaneously energizing a second heating element of the oven during the first stage.

DETAILED DESCRIPTION

Figure 1:
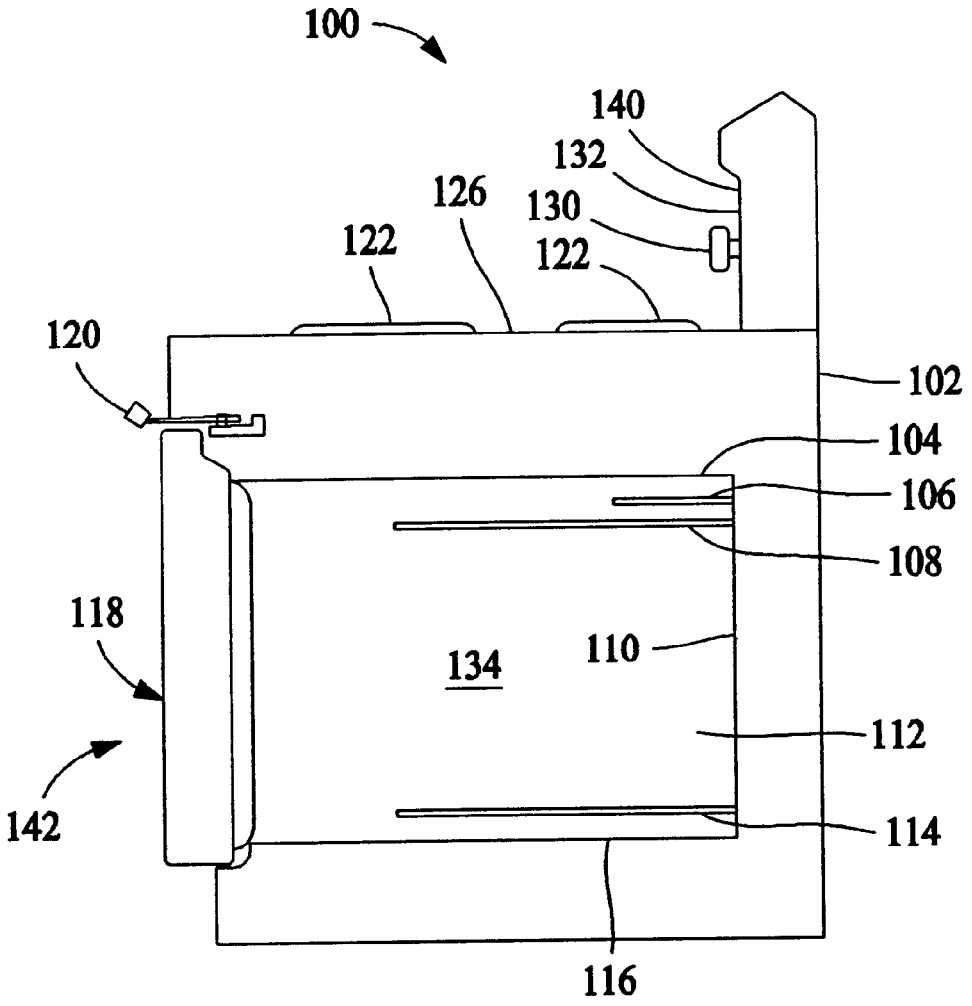
FIG. 1 is an embodiment of an electric range having a self-cleaning oven in which a self-cleaning system and method is implemented.

FIG. 1 is an embodiment of an electric range 100 having a self-cleaning oven 142 in which the herein described self-cleaning system and method is implemented. While a free standing electric range is shown, it will be understood that the self-cleaning system and method is equally applicable to other self-cleaning oven products as well. Examples of other oven products include a speedcooking oven and a wall oven.

Range 100 includes an outer cabinet 102 with a top cooking surface 126 having individual surface heating elements 122. Positioned within cabinet 102 is a cooking chamber 134 or cavity formed by a box-like oven liner having vertical side walls 112, top wall 104, bottom wall 116, rear wall 110 and a front opening drop door 118. Chamber 134 is provided with two heating elements, a bake heating element 114 positioned adjacent bottom wall 116 and a broil heating element 108 positioned adjacent top wall 104.

A temperature probe or sensor 106 is mounted to project into chamber 134 and senses a temperature within chamber 134. A door latch handle 120 is used for locking door 118 in a closed position during a self-cleaning operation. A control knob 130 extends outwardly from a control panel 132, which is supported from a back splash 140 of range 100.

Self-cleaning oven 142 has a power rating of at least 21 amperes so that bake and broil heating elements 114–116 of self-cleaning oven 142 can be simultaneously energized during the self-cleaning operation. In one embodiment, self-cleaning oven 142 has a power rating that ranges from 30 amperes to 40 amperes. In another embodiment, self-cleaning oven 142 has a power rating that ranges from 25 amperes to 30 amperes. In yet another embodiment, self-cleaning oven 142 has a power rating that ranges from 30 amperes to 35 amperes. In still another embodiment, self-cleaning oven 142 has a power rating of 30 amperes.

Figure 2:
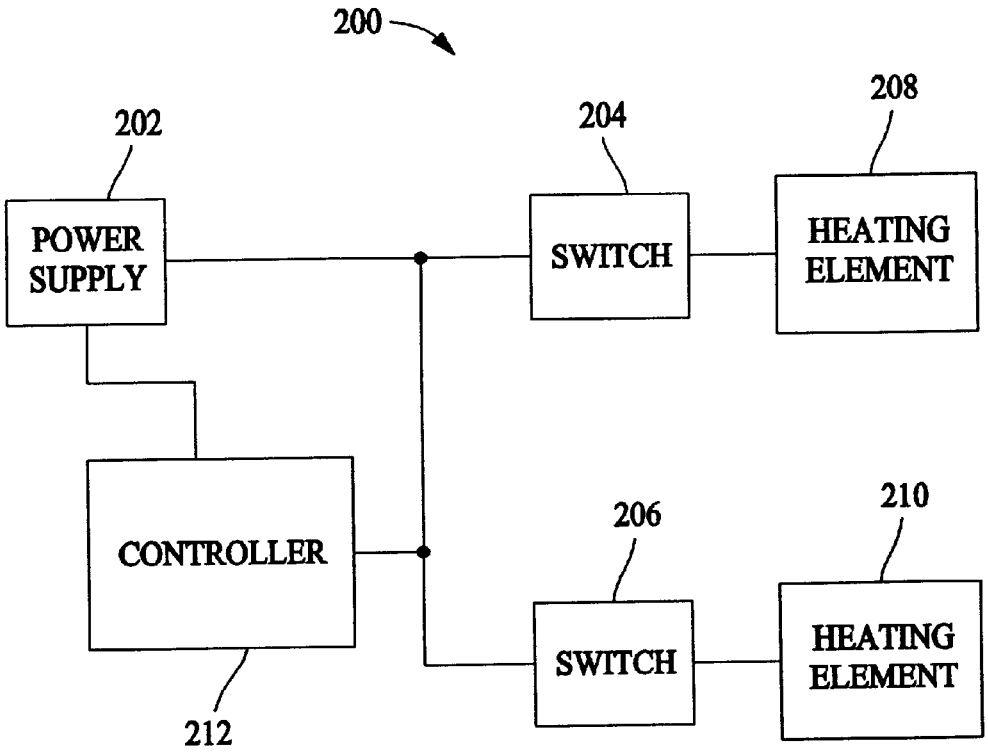
FIG. 2 is a functional block diagram of an embodiment of a self-cleaning system.

FIG. 2 is a functional block diagram of an embodiment of a self-cleaning system 200. The self-cleaning system 200 has a controller 212, heating elements 208–210, and switches 204–206. An example of heating element 208 is broil heating element 108 of self-cleaning oven 142 and an example of heating element 210 is bake heating element 114 of self-cleaning oven 142. Heating element 208 is coupled to controller 212 via switch 204 and heating element 210 is coupled to controller via switch 206. Heating element 208 is coupled to a power supply 202 via switch 204 and heating element 210 is coupled to power supply 202 via switch 206. Controller 212 is coupled to power supply 202.

During a first stage of the self-cleaning operation, controller 212 simultaneously energizes both heating elements 208–210. For instance, controller 212 energizes broil heating element 108 so that broil heating element 108 is energized for all the time during the first stage. Controller 212 periodically energizes bake heating element 114 also during the first stage so that bake heating element 114 has a duty cycle. An example of periodic energization of bake heating element 114 is when bake heating element 114 is energized for 30 seconds, then deenergized for 30 seconds, then energized for 30 seconds, and so on. Another example of periodic energization of bake heating element 114 is when bake heating element 114 is energized for 60 seconds, then deenergized for 60 seconds, then energized for 60 seconds, and so on. When heating element 208 is energized, switch 204 is on. When heating element 210 is energized, switch 206 is on. During a second stage of the self-cleaning operation, controller 212 periodically energizes heating elements 208–210. For instance, broil heating element 108 is initially energized. Then, broil heating element 108 is deenergized and bake heating element 114 is energized. Then, bake heating element 114 is deenergized and broil heating element 108 is energized.

Figure 3:
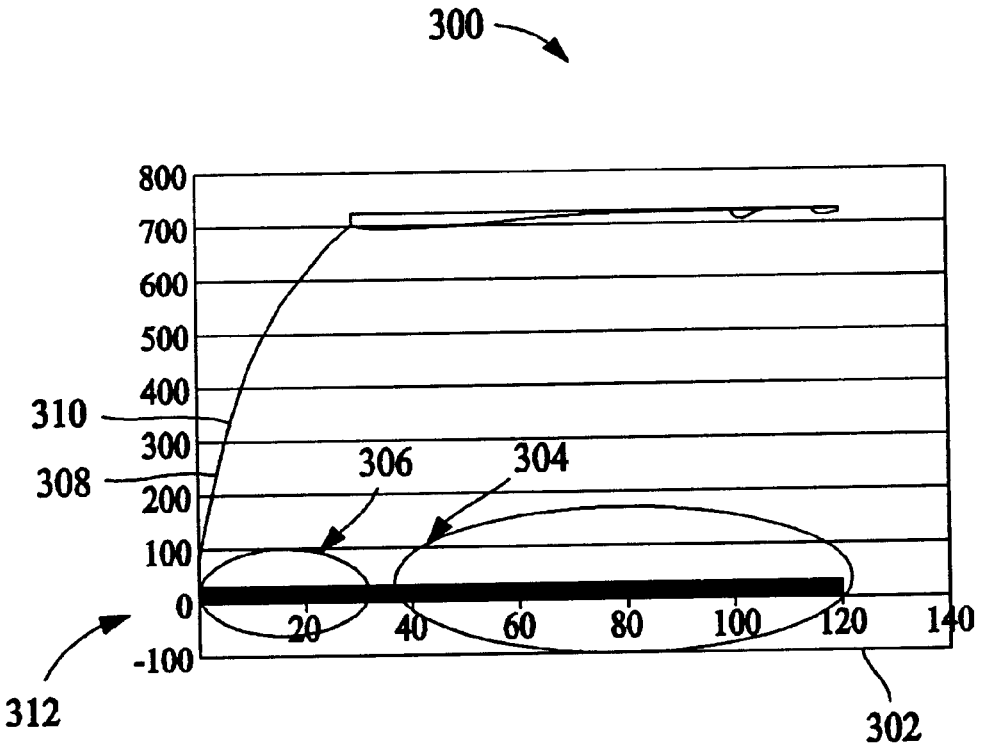
FIG. 3 is a plot illustrating execution of an embodiment of a self-cleaning method.

FIG. 3 is a plot 300 illustrating execution of an embodiment of a self-cleaning method. Time, which is measured in minutes, progresses along an abscissa 302 from left to right. Temperature, which is measured in degrees Fahrenheit, progresses along an ordinate 308 from bottom to top.

During the first stage of the self-cleaning operation, temperature inside chamber 134 increases from about 70 degrees Fahrenheit to about 700 degrees Fahrenheit, as shown by a curve 310. Moreover, during the first stage, both broil and bake heating elements 108 and 114 are simultaneously energized, which is shown by a portion 306 of a timing diagram 312 of plot 300. As an example, portion 306 is a result of broil heating element 108 being energized for 100 percent of the time during the first stage and bake heating element 114 being periodically energized such that bake heating element 114 is alternately energized and deenergized every 30 seconds. As another example, portion 306 is a result of broil heating element 108 being energized for 100 percent of the time during the first stage and bake heating element 114 being alternately energized and deenergized every 45 seconds. As yet another example, portion 306 is a result of broil heating element 108 being energized for 100 percent of the time during the first stage and bake heating element 114 being alternately energized and deenergized every 60 seconds.

During the second stage, chamber 134 experiences a decrease in temperature for a first time during the self-cleaning operation. The second stage is shown by a portion 304 of the timing diagram 312. During the second stage, broil and bake heating elements 108 and 114 are not simultaneously energized but are periodically energized. For instance, broil heating element 108 is energized for 5 minutes. Once broil heating element 108 is deenergized, bake heating element 114 is energized for 5 minutes. Once bake heating element 114 is deenergized, broil heating element 108 is energized for 5 minutes, and so on. As another instance, broil heating element 108 is energized for 2 minutes. Once broil heating element 108 is deenergized, bake heating element 114 is energized for 2 minutes. Once bake heating element 114 is deenergized, broil heating element 108 is energized for 2 minutes, and so on. In one embodiment, the self-cleaning operation is completed within 3 hours. In another embodiment, the self-cleaning operation is completed within 2 hours and 30 minutes. In yet another embodiment, the self-cleaning operation is completed within 2 hours and 15 minutes. As evident from plot 300, the self-cleaning operation completes in 2 hours.

While the invention has been described in terms of various specific embodiments, those skilled in the art will recognize that the invention can be practiced with modification within the spirit and scope of the claims.

What is claimed is:

1. A self-cleaning oven comprising:

a cooking chamber;

a first heating element inside the cooking chamber;

a second heating element inside the cooking chamber, the first and second heating elements configured to be energized simultaneously during a first stage of a self-cleaning operation of the oven, and the first and second heating elements configured to be periodically energized during a second stage of the self-cleaning operation.

2. A self-cleaning oven in accordance with claim 1, wherein the first heating element is coupled to a controller via a first switch, and the second heating element is coupled to the controller via a second switch.

3. A self-cleaning oven in accordance with claim 1, wherein the oven has an ampere circuit rating of at least 21 amperes.

4. A self-cleaning oven in accordance with claim 1, wherein the oven has an ampere circuit rating of 30 amperes.

5. A self-cleaning oven in accordance with claim 1, wherein the first heating element is a broil heating element that is positioned at a top end inside the oven, and the second heating element is a bake heating element that is positioned at a bottom end inside the oven.

6. A method for performing a self-cleaning operation in an oven, the method comprising:

energizing a first heating element of the oven during a first stage of a self-cleaning operation; and periodically energizing a second heating element of the oven during the first stage.

7. A method in accordance with claim 6, further comprising periodically energizing the first and second heating elements during a second stage of the self-cleaning operation.

8. A method in accordance with claim 6, wherein the periodically energizing comprises energizing the second heating element for a first amount of time, and deenergizing the second heating element for a second amount of time following the first amount of time.

9. A method in accordance with claim 6, wherein the periodically energizing comprises energizing the second heating element for 30 seconds, and deenergizing the second heating element for the next 30 seconds.

10. A method in accordance with claim 6, further comprising performing the self-cleaning operation within 3 hours.

11. An electric range comprising:

at least one surface heating element;

a cooking chamber located below the surface heating element;

a first heating element inside the cooking chamber;

a second heating element inside the cooking chamber, the first and second heating elements configured to be energized simultaneously during a first stage of a self-cleaning operation of the oven, and the first and second heating elements configured to be periodically energized during a second stage of the self-cleaning operation.

12. An electric range in accordance with claim 4, wherein the first heating element is coupled to a controller via a first switch, and the second heating element is coupled to the controller via a second switch.

13. An electric range in accordance with claim 4, wherein the oven has an ampere circuit rating of at least 21 amperes.

14. An electric range in accordance with claim 4, wherein the oven has an ampere circuit rating of 30 amperes.

15. An electric range in accordance with claim 4, wherein the first heating element is a broil heating element that is positioned at a top end inside the oven, and the second heating element is a bake heating element that is positioned at a bottom end inside the oven.

16. An electric range in accordance with claim 4, wherein the self-cleaning operation is performed within 3 hours.

17. An electric range in accordance with claim 4, wherein the self-cleaning operation is performed in 2 hours.

* * * * *

UNITED STATES PATENT AND TRADEMARK OFFICE

CERTIFICATE OF CORRECTION

PATENT NO. : 6,730,879 B1
DATED : May 4, 2004
INVENTOR(S) : Muegge et al.

It is certified that error appears in the above-identified patent and that said Letters Patent is hereby corrected as shown below:

Column 4,
Lines 45, 49, 51, 53, 58 and 60, delete “4” and insert therefor -- 11 --.

Signed and Sealed this

Twentieth Day of December, 2005

JON W. DUDAS
*Director of the United States Patent and Trademark Office*